US005101897A

United States Patent [19]

Leismer et al.

[11] Patent Number: 5,101,897

[45] Date of Patent: Apr. 7, 1992

[54] SLIP MECHANISM FOR A WELL TOOL

[75] Inventors: Dwayne D. Leismer, Pearland; Danny W. Wagoner, Sugarland, both of Tex.

[73] Assignee: Camco International Inc., Houston, Tex.

[21] Appl. No.: 641,027

[22] Filed: Jan. 14, 1991

[51] Int. Cl.[5] ..... E21B 33/129

[52] U.S. Cl. ..... 166/217; 166/134

[58] Field of Search ..... 166/206, 207, 208, 216, 166/217, 134; 285/141

[56] References Cited

U.S. PATENT DOCUMENTS

| | | | |
|---|---|---|---|
| 2,155,380 | 4/1939 | Bean | 166/217 |
| 2,805,723 | 9/1957 | Young | 166/134 |
| 2,880,806 | 4/1959 | Davis | 166/217 |
| 3,530,934 | 9/1970 | Kisling, III | 166/134 |
| 4,498,534 | 2/1985 | Lindsey, Jr. | 166/208 |
| 4,582,134 | 4/1986 | Gano et al. | 166/217 |
| 4,791,987 | 12/1988 | Cassity et al. | 166/217 |
| 4,949,786 | 8/1990 | Eckert et al. | 166/217 |

*Primary Examiner*—Terry Lee Melius

*Attorney, Agent, or Firm*—Fulbright & Jaworski

[57] ABSTRACT

A slip mechanism for anchoring a well tool in a well conduit. A first cylindrical wedge member having on its outer surface a plurality of circumferentially extending grooves, preferably forming a helix in which the grooves include an outwardly tapered side. A second cylindrical shaped slip member having a plurality of slips is positioned outside of the first member and includes a plurality of teeth on its outer surface and includes ridges mating with and coacting with the grooves on the first member. The ridges include a tapered side coacting with the tapered sides of said first member for providing radial displacement of the slip when the wedge member and slip member are moved axially to each other.

2 Claims, 4 Drawing Sheets

SLIP MECHANISM FOR A WELL TOOL

BACKGROUND OF THE INVENTION

It is well known to utilize a slip mechanism for anchoring and/or supporting a downhole well tool in a well conduit such as a casing.

The slip mechanism of a downhole well tool such as a hanger or a packer bites into and locks into the casing. The set slip mechanism supports the weight of a tubing string attached to a hanger or a packer and any pressure differentials to which the packer may be subjected. Setting the well tool requires an axial load from a setting device which is translated into a radial force by means of a wedge which forces the exterior teeth of the slip into the casing interior wall. The weight of the tubing string may then be supported by the slip teeth. Since the magnitude of the radial force translated by the wedge is directly proportional to the magnitude of the axial force, an increased axial load will increase the radial holding force.

In some instances, using conventional slips the weight of the tubing string may be great enough so that the corresponding radial force will overstress the casing. This will not normally occur in a bottom hole packer installation where the packer is set in casing that is surrounded by cement. The support from the cement gives the casing greater load carrying capacity. However, in a hanger or shallow set packer installation, the casing may be unsupported and may be subjected to high tubing pressure due to weight and/or pressure loads. In order not to overstress the casing, hanging loads applied to shallow set hangers or packers must be limited.

The present invention is directed to a slip mechanism for a well tool which distributes the radial load transmitted to the casing wall more evenly and over a larger area thereby allowing longer and heavier tubing loads to be supported without overstressing the casing.

SUMMARY

The present invention is directed to a slip mechanism for anchoring a well tool having a cylindrical body from the inside of a well conduit. The mechanism includes a first cylindrical wedge member positioned on the outside of the well tool body. The wedge member includes in its outer surface a plurality of circumferentially extending grooves and said grooves include an outwardly tapered side. A second cylindrically shaped split slip member is positioned outside of the wedge member. The slip member includes a plurality of teeth, preferably formed by helical threads, in its outer surface and said slip member includes ridges on its inner surface mating with and coacting with the grooves on said wedge member. The ridges include a tapered side coacting with the tapered side of the wedge member for providing radial displacement of the slips when the wedge member and slip are moved relative to each other.

A further object of the present invention is wherein the circumferential grooves form a helical thread and said ridges form a helical mating thread.

Yet a still further object of the present invention is wherein the wedge member and the slip member include coacting mating stop shoulders for limiting the radial displacement of the slip member.

Still a further object of the present invention is wherein the slip member initially has an outer diameter matching the well conduit internal diameter before being split into a plurality of individual slips.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

While the present slip mechanism of the present invention will be described in conjunction with its use in a well packer, for purposes of illustration only, it is to be understood that the present slip mechanism can be used in other well tools for anchoring and/or supporting a well tool from the inside of a well conduit, such as for example only, a well hanger.

Figure 2:
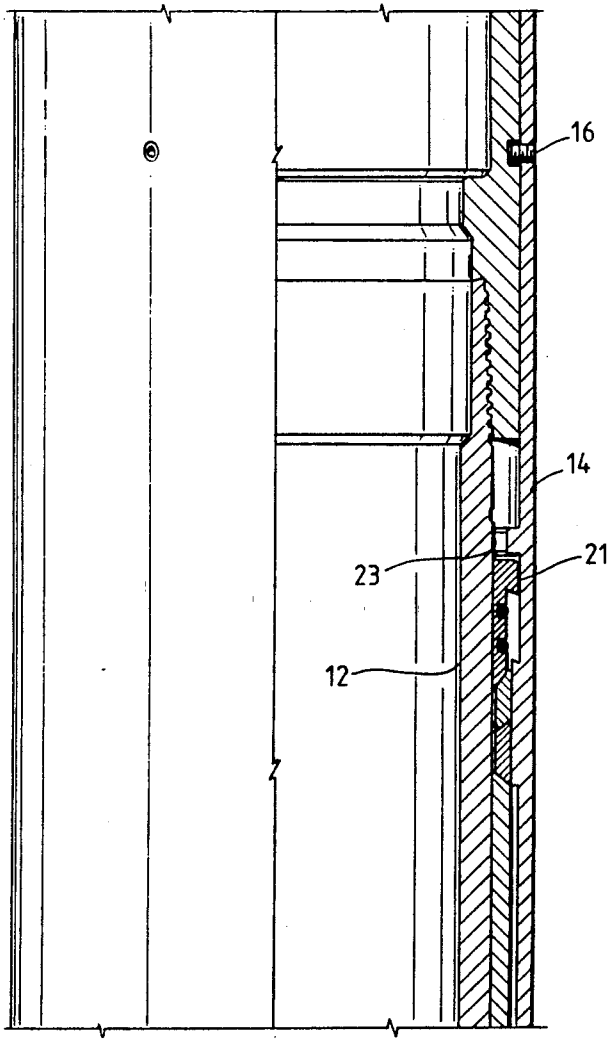
FIGS. 1-5 are elevational views, in quarter section, and are continuations of each other, of a well packer utilizing the slip mechanism of the present invention.
Figure 1:
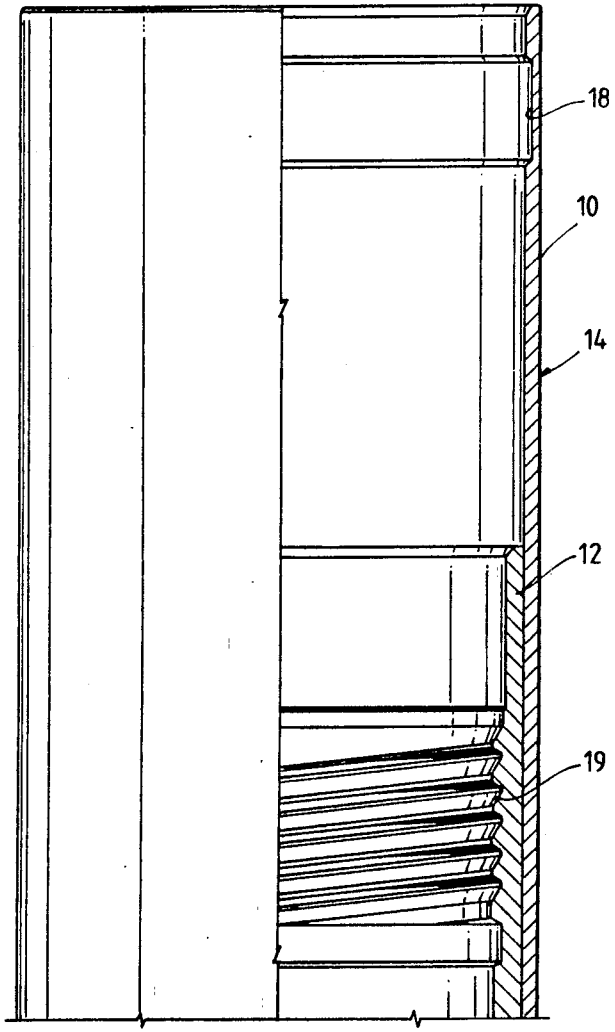
Figure 6:
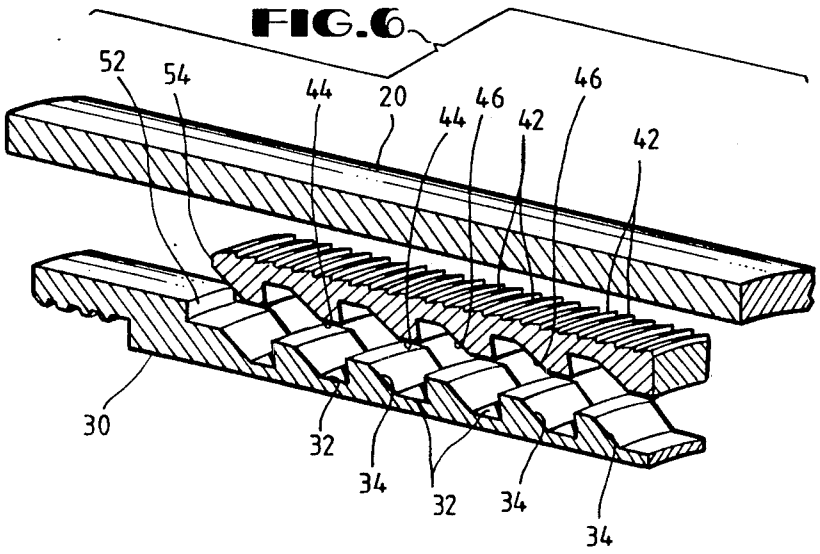
FIG. 6 is an exploded perspective, fragmentary sectional view illustrating the principle of operation of the present invention.
Figure 5:
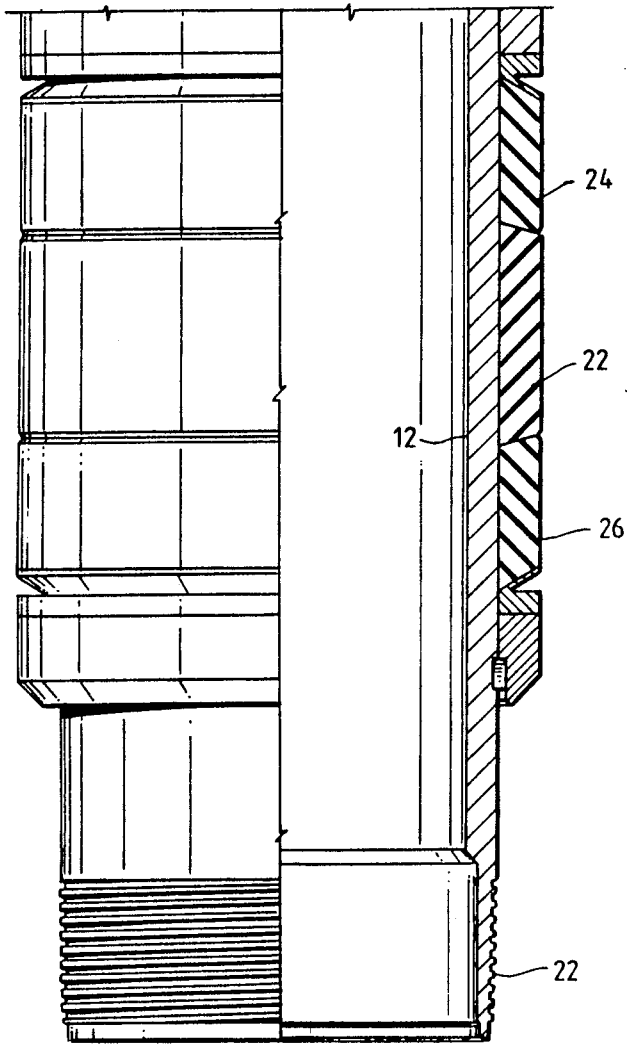

Referring now to the drawings, the numeral 10 generally indicates a Camco Mudline Hanger Packer utilizing the slip mechanism of the present invention. The packer 10 includes an inner body 12, and an outer body 14, which are normally held together and prevented from relative axial movement by shear pin 16 (FIG. 2). The Packer 10 includes means 18 (FIG. 1) for engagement by a suitable and conventional tool for moving the packer 10 into a well conduit such as a casing 20 (FIG. 6) and includes connecting means 22 at its lower end (FIG. 5) for supporting a tubing string.

Suitable sealing means, such as conventional resilient sealing elements 22 and 24 and 26 (FIG. 5) are positioned on the inner body 12 for expansion into and engagement with and sealing against the interior of a well conduit or casing 20. Conventional slips 27 (FIG. 4) are provided which ride upon cone member 29 for being set into an expanded position for holding the sealing elements 22, 24 and 26 in a set position.

In addition, most well packers have additional slip mechanisms similar to slips 27 and 29 for engagement with the interior of a well conduit or casing 20 for anchoring and/or supporting the well packer 10 and any well tubing connected to the connection 22. While such conventional slips and cone mechanisms are satisfactory in many installations, such conventional slip mechanisms may, if the weight of the tubing string is great enough, provide a radial force which will overstress a casing such as one that is not backed up or supported, such as by cement.

Figure 3:
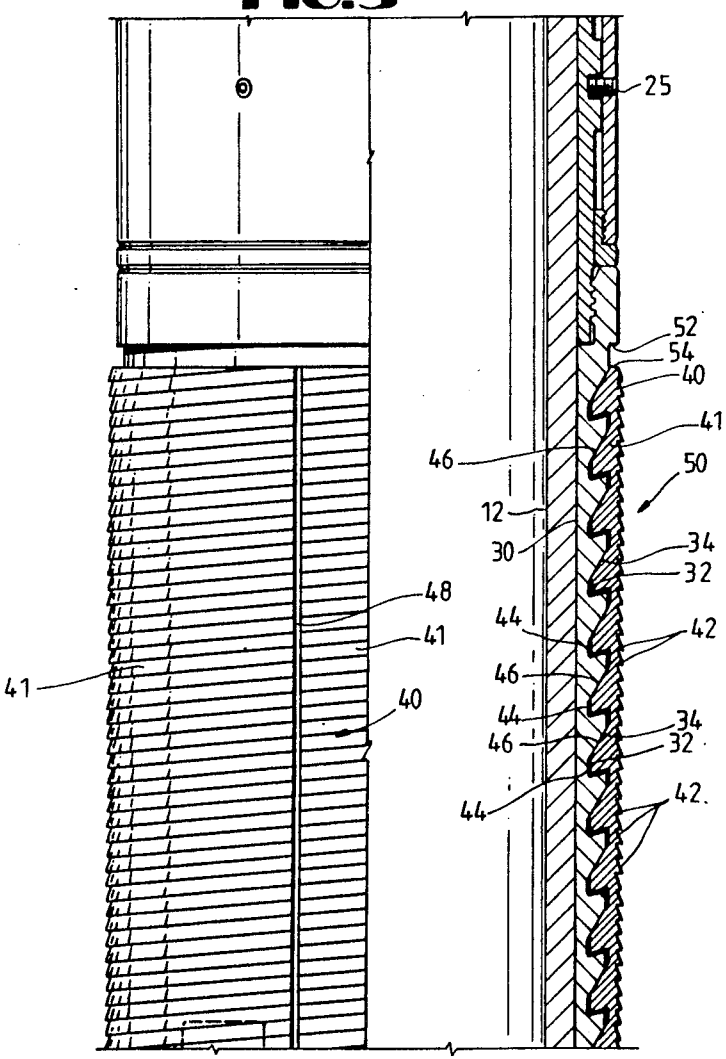

The present invention is directed to a slip mechanism generally indicated by the reference numeral 50 (FIGS. 3, 4 and 6) which includes a cylindrical wedge tool from the inside of a well conduit, such as for example only, a well hanger.

Referring now to the drawings, the numeral 10 generally indicates a Camco Mudline Hanger Packer utilizing the slip mechanism of the present invention. The packer 10 includes an inner body 12, and an outer body 14, which are normally held together and prevented from relative axial movement by shear pin 16 (FIG. 2). The packer 10 includes means 18 (FIG. 1) for engagement by a suitable and conventional tool for moving the packer 10 into a well conduit such as a casing 20 (FIG. 6) and includes connecting means 22 at its lower end (FIG. 5) for supporting a tubing string.

Suitable sealing means, such as conventional resilient sealing elements 22 and 24 and 26 (FIG. 5) are positioned on the inner body 12 for expansion into and engagement with and sealing against the interior of a well conduit or casing 20. Conventional slips 27 (FIG. 4) are provided which ride upon cone member 29 for being set into an expanded position for holding the sealing elements 22, 24 and 26 in a set position.

In addition, most well packers have additional slip mechanisms similar to slips 27 and 29 for engagement with the interior of a well conduit or casing 20 for anchoring and/or supporting the well packer 10 and any well tubing connected to the connection 22. While such conventional slips and cone mechanisms are satisfactory in many installations, such conventional slip mechanisms may, if the weight of the tubing string is great enough, provide a radial force which will overstress a casing such as one that is not backed up or supported, such as by cement.

The present invention is directed to a slip mechanism generally indicated by the reference numeral 50 (FIGS. 3, 4 and 6) which includes a cylindrical wedge translating and load between the wedge 30 and the slip 40. The pitch angle of the helix and the angle of the tapered sides 34 and 46 can be adjusted to provide a load necessary to engage the external teeth 42 into the casing without overstressing the casing. This design is adjustable for any load by changing slip length, thread angle and/or pitch.

The slip member 40 is preferably a plurality of separate slip segments 41. In addition, the slip member 40 is a cylinder in which the slip 40 is initially cut to match the inside diameter of the casing 20. Slip 40 is slotted at a plurality of slots 48 forming individual slips 41. The slots 48 are provided with a minimal gap when the slip member 40 is in the run position. This effectively maximizes the circumferential area to provide lower stress levels when the slips are actuated.

Coacting mating stop shoulders 52 and 54 are provided on the wedge member 30, and the slip member 40, respectively. Stop shoulders 52 and 54 limit the maximum amount of radial travel between the slip member 40 and the slips 41 and the wedge 30 thereby limiting the maximum amount of radial force exerted on the casing 20 in order to avoid overstressing the casing 20.

By the use of the helical grooves 32 and coacting helical ridges 44, the slip mechanism 50 distributes the radial and axial force components over the entire length of the slip 50 since the helix is evenly spaced over the required length. The bearing support area on the inside of the slip 50 is greater than a conventional wedge because of the helix. This design prevents the casing 20 from being overstressed, will support greater tubing weight, and will withstand greater packer pressure differentials. Furthermore, the manufacturing ease is greatly enhanced by producing controlled tolerances due to cutting a helix or thread at the wedge/slip interface.

Figure 4:
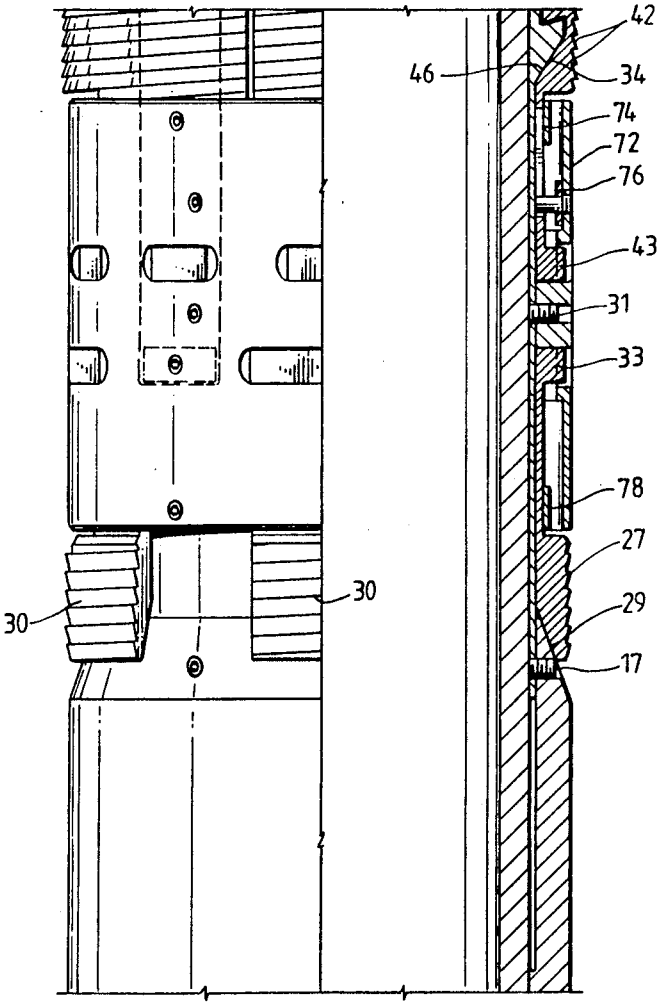

Referring now to FIG. 4, the ends 33 and 43 of slips 27 and 41, respectively, are retained in position by a slip retaining housing 72. Retracting springs 74, 72, 76 yieldably urge the ships to a retracted position.

Figure 7:
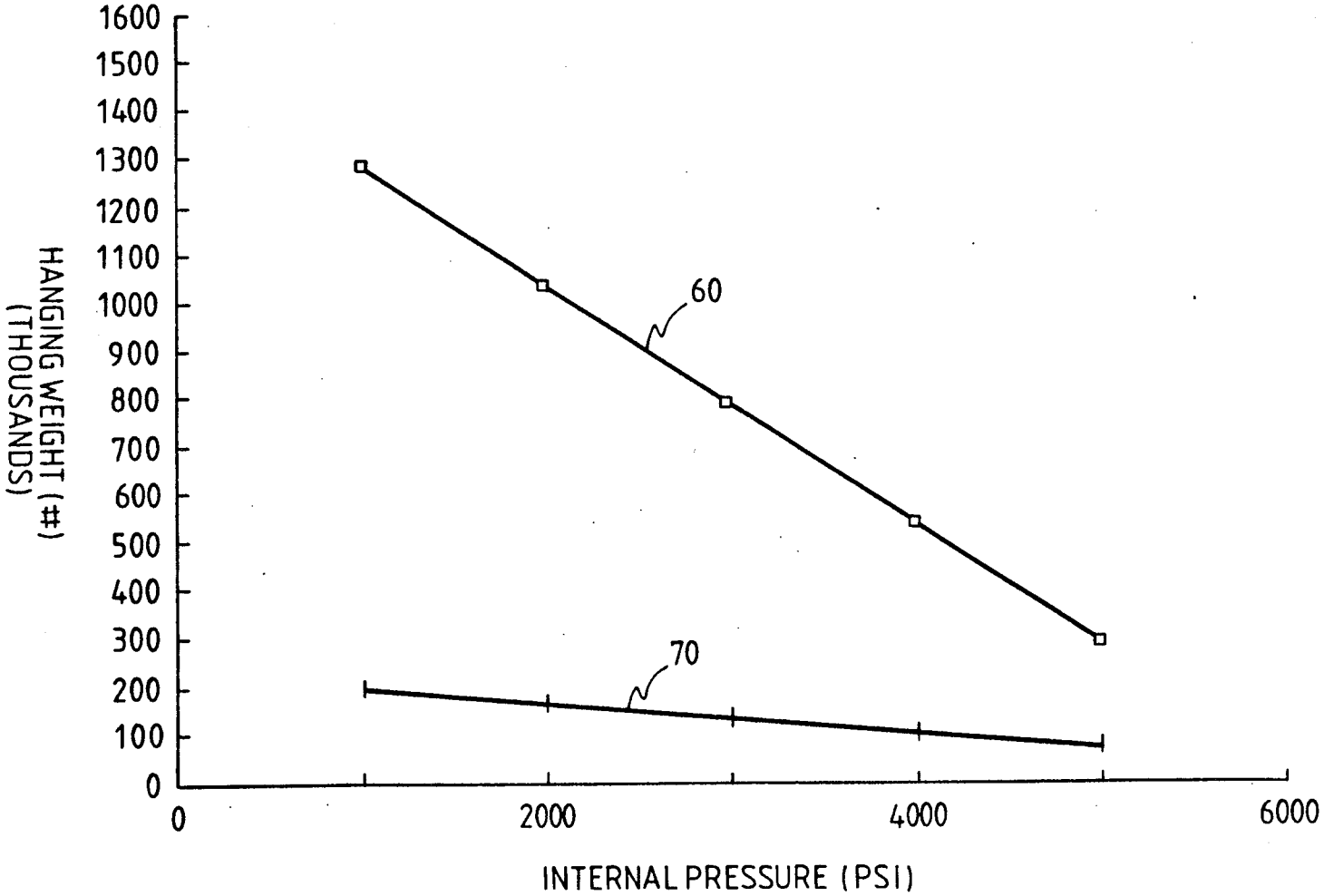
FIG. 7 is a calculated graph comparing the hanging weight present invention with a conventional slip.

Referring to FIG. 7, calculated graphs 60 and 70 illustrate the advantage of the holding power of the present invention as compared with conventional slips such as slips 27 shown in FIG. 4. The calculations are made for a nonsupported (no concrete backup) casing showing hanging load versus the internal tubing pressure in the casing. It is to be particularly noted that applicant's helical slip may have a slip area of 359 square inches while the conventional slip area is only 94 square inches. This advantage is provided because the present slip mechanism provides bearing support over the entire length of the slip while in a conventional slip the bearing support is limited.

In operation, the packer 10 is lowered into the casing 20 by a conventional supporting tool engaging the notch 18 and/or face of the outer body 14 and engaging the threaded connection 19 on the inner body 12. When the packer 10 is lowered to the proper depth in the casing 20, the supporting and actuating tool moves the outer body 14 axially downward relative to the inner body 12 shearing the pin 16 (FIG. 2) and thereafter shearing pin 17 (FIG. 4). Upward movement of the inner body 12 sets the packing means 22, 24 and 26 (FIG. 5) moves the cone 29 behind the conventional slips 30 (FIG. 4) and sets the slips 30 against the interior of the casing 20. Further downward movement shears pin 31 of the outer body 14 moving the slip 40 relative to the wedge member 30 driving the slip 40 radially outwardly into the interior of the casing 20. The packer 10 is held in the set position with the sealing means and the slip means expanded and set by ratchets 21 engaging teeth 23 (FIG. 2) on the outer periphery of the inner body 12. The supporting and setting tool can then be removed. The packer 10 can be released by a pulling tool engaging the recess 18 pulling upon the outer body 14 shearing the release pin 25 raising the wedge member 30 relative to the slips 40.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts, will be readily apparent to those skilled in the art and which are encompassed within the spirit of the invention and the scope of the appended claims.

What is claimed is:

1. A slip mechanism for anchoring a well tool having a cylindrical body from the inside of a well conduit comprising, a cylindrical wedge member positioned on the outside of the body, said wedge member including in its outer surface a plurality of circumferential grooves extending entirely around the member, said grooves including an outwardly tapered side, a cylindrically shaped split slip member positioned outside of said wedge member, said slip member including a plurality of teeth on its outer surface, said slip member including ridges on its inner surface mating with and coacting with the grooves on said wedge member, said ridges including a tapered side coacting with the tapered sides of said wedge member for providing radial displacement of the slip when the wedge member and slip are moved axially relative to each other, said circumferential grooves form a helical thread and said ridges form a helical mating surface, and said slip member includes a plurality of circumferentially spaced segmented slips for providing increased contact area with the inside of the well conduit and increasing the load carrying capacity of the slip mechanism.

2. The slip mechanism of claim 1 including coacting mating stop shoulders on the wedge member and the slip member for limiting the radial displacement of the slip member.

* * * * *

UNITED STATES PATENT AND TRADEMARK OFFICE

CERTIFICATE OF CORRECTION

PATENT NO. : 5,101,897

DATED : April 7, 1992

INVENTOR(S) : Dwayne D. Leismer et al

It is certified that error appears in the above-indentified patent and that said Letters Patent is hereby corrected as shown below:

Column 2, line 61, beginning with "tool" through Column 3, line 35, delete entire text.

Insert the following text beginning with Column 2, line 61, after "wedge" -- member 30 and a cylindrically shaped slit slip member 40 formed by a plurality, for example ten, individual slips 41 which distributes the radial force transmitted to the casing wall more evenly and over a larger area of the casing wall thereby allowing longer and heavier tubing strings to be used without overstressing the casing 20.

The cylindrical wedge member 30 is positioned on the outside of the inner body 12 for axial movement thereto. The wedge member 30 includes in its outer surface a plurality of circumferentially extending grooves 32 and said grooves include an outwardly tapered side 34. The cylindrically shaped slip member 40 having slips 41 is positioned outside of the wedge member 30 and is axially movable thereto. The slip member 40 includes a plurality of teeth 42 on its outer surface for biting into the interior of the casing 20 for anchoring and supporting the packer 10 therefrom. Preferably, the teeth are formed by helical threads. The slip member 40 also includes ridges 44 on its inner surface mating with and coacting with the grooves 32 on the wedge member 30. The ridges 44 include tapered sides 46 which coact with the tapered sides 34 of the wedge member 30 for providing radial displacement of the slip 40 when the wedge member 30 and slip 40 are moved axially relative to each other.

UNITED STATES PATENT AND TRADEMARK OFFICE

CERTIFICATE OF CORRECTION

PATENT NO. : 5,101,897

DATED : April 7, 1992

INVENTOR(S) : Dwayne D. Leismer et al

It is certified that error appears in the above-indentified patent and that said Letters Patent is hereby corrected as shown below:

Preferably, the circumferential grooves 32 form a helical thread and the ridges 44 form a helical mating thread. While the grooves 32 and ridges 44 could be cylindrical multiple grooves, the tolerances involved could cause undesirable stress concentrations and possibly cracking of the slip 40 from a non-even distribution of the load. Using the preferred embodiment of a helical thread, the position between the load angles will be the same for every contact point between the wedge 30 and the slip 40.. The helical thread has a pitch that can be varied to provide the proper bearing surface for translating and load between the wedge 30 and the slip 40. The pitch angle of the helix and the angle of the tapered sides 34 and 46 can be adjusted to provide a load necessary to engage the external teeth 42 into the casing without overstressing the casing. This design is adjustable for any load by changing slip length, thread angle and/or pitch. --

Signed and Sealed this

Fourteenth Day of September, 1993

Bruce Lehman

*Attest:*

BRUCE LEHMAN

*Attesting Officer*

*Commissioner of Patents and Trademarks*